US005800603A

United States Patent [19]

Cruslock et al.

[11] Patent Number: 5,800,603

[45] Date of Patent: Sep. 1, 1998

[54] ZEOLITE DISPERSION

[75] Inventors: Ylva Cruslock, Mölndal; Maj-Lis Dahlgren, Nödinge; Lars Lindahl, Göteborg, all of Sweden

[73] Assignee: Eka Chemicals AB, Stockholm, Sweden

[21] Appl. No.: 823,443

[22] Filed: Mar. 24, 1997

Related U.S. Application Data

[60] Provisional application No. 60/014,535 Apr. 2, 1996.

[30] Foreign Application Priority Data

Mar. 25, 1996 [SE] Sweden ..... 9601134

[51] Int. Cl.[6] ..... C09D 7/02; C09D 105/00; B01J 13/00

[52] U.S. Cl. ..... 106/205.9; 252/313.1

[58] Field of Search ..... 106/205.9; 252/313.1

[56] References Cited

U.S. PATENT DOCUMENTS

| | | | |
|---|---|---|---|
| 4,519,844 | 5/1985 | Chaux et al. | 106/205.2 |
| 4,548,734 | 10/1985 | Chaux et al. | 252/311 |
| 5,401,432 | 3/1995 | Jourbert et al. | 510/418 |

FOREIGN PATENT DOCUMENTS

| | | | |
|---|---|---|---|
| 000154291A2 | 11/1985 | European Pat. Off. . | |
| 0 540 076 | 5/1993 | European Pat. Off. | D21H 17/68 |
| 57-61614 | 4/1982 | Japan | C01B 33/28 |
| 401225699A | 8/1989 | Japan . | |

*Primary Examiner*—David Brunsman
*Attorney, Agent, or Firm*—Ralph J. Mancini

[57] ABSTRACT

An aqueous dispersion comprising particles of a zeolite having a hydrophobicity of below about 9.0 percent by weight residual butanol as determined by the Residual Butanol Test, which dispersion comprises a stabilizing amount of biogum. Production of the dispersion comprising mixing zeolite particles with a biogum into a dry mixture; and mixing the dry mixture with water under agitation into a homogeneous mixture. Use of the dispersion for binding particles of zeolite to fibers. Production of paper or paperboard by forming and dewatering a suspension of cellulosic fibers wherein dewatering is carried out in the presence of particles of a zeolite, the dispersion being added to the suspension prior to dewatering. Production of dry-laid paper, nonwoven or fluff pulp, in which cellulosic fibers are carried by a gas stream, in which the dispersion is sprayed onto the fibers while they are carried by the gas stream.

8 Claims, No Drawings

ZEOLITE DISPERSION

This present application claims priority of Swedish patent application no. 5 9601134-1 filed on Mar. 25, 1996 and benefit of U.S. provisional application Ser. No. 60/014,535 filed Apr. 2,1996 under 35 U.S.C. §119.

FIELD OF INVENTION

The present invention relates to aqueous dispersions of particulate hydrophobic zeolites and to the use of said dispersion as an aid for binding hydrophobic zeolites to surfaces of natural as well as synthetic fibres in wet as well as dry state. Furthermore the present invention relates to wet as well as dry methods for production of fibrous materials such as paper, paperboard, nonwoven, flake-dried pulp and suchlike, wherein said dispersion is used in order to increase the retention of an added hydrophobic zeolite. In this context "retention" means the relation between the amount of a certain additive retained by the fibres and the total amount of said additive added to said fibres within a process step.

BACKGROUND OF THE INVENTION

Storage stable aqueous zeolite dispersions are described in Japanese Laid-Open No. 82-61614: a water-soluble cellulose derivative is used in combination with a water-soluble salt to stabilise such a dispersion. The dispersions are however not suggested to be useful when binding hydrophobic zeolites to surfaces of fibres. It has actually been found that the dispersions according to JP 82-61614 in fact are not stable when applied to hydrophobic zeolites.

Thus the problem to be solved by the present invention is to provide a stable aqueous dispersion of particulate hydrophobic zeolites, which dispersion is useful when binding hydrophobic zeolites to fibres. By a hydrophobic zeolite is, in this context, meant a zeolite having a hydrophobicity of below about 0.9 percent by weight residual butanol as determined by the Residual Butanol Test.

This problem is solved by an aqueous dispersion having the features set out in the characterising clause of appended claim 1, i.e. the dispersion comprises a stabilising amount of a biogum.

Zeolites are inorganic crystalline compounds mainly comprising $SiO_2$ and $Al_2O_3$ in tetrahedral coordination. In the context of the present invention, the term "zeolites" also bears upon other crystalline compounds of zeolite structure, such as aluminium phosphates. Such crystalline compounds of zeolite structure that can be used in the invention are defined in W. M. Meier et al. "Atlas of zeolite structure types", 2nd. ed., Butterworths, London, 1987, hereby incorporated by reference in the present application.

SUMMARY OF INVENTION

The present invention generally relates to an aqueous dispersion comprising particles of a zeolite having a hydrophobicity of below about 0.9 percent by weight residual butanol as determined by the Residual Butanol Test, wherein said dispersion comprises a stabilising amount of a biogum. The invention also relates to several method for the preparation of such dispersion.

DETAILED DESCRIPTION OF THE INVENTION

In the present invention, the zeolites have a restricted capacity for taking up water. Such a hydrophobic (water-repellent) nature also involves an increased capacity for associating with non-polar compounds, among which the organic substances constitute 15 the largest group. The present dispersion may contain more than one type of zeolite, for instance two hydrophobic zeolites, or a combination of one or more hydrophilic zeolites with one or more hydrophobic zeolites.

In the present invention, it is preferred that the molar ratio of $SiO_2$ to $Al_2O_3$ in tetrahedral coordination should be at least about 10:1. Suitably, the molar ratio lies in a range of from 12:1 to 1000:1, preferably in a range of from 20:1 to 500:1.

The hydrophobicity of zeolites may be determined by a so-called Residual Butanol Test, described in GB-A-2,014,970. In this test, the zeolite is activated by heating in air for 16 hours at 300° C. Then, 10 parts by weight of the thus-activated zeolite are mixed with a solution consisting of 1 part by weight of I-butanol and 100 parts by weight of water. The resulting slurry is slowly agitated for 16 hours at 25° C. Finally, the residual content of I-butanol in the solution is determined and indicated in per cent by weight. Thus, a low value indicates a high degree of hydrophobicity.

In the present invention, the hydrophobicity is suitably distinguished by a residual butanol content below about 0.9% by weight, preferably below about 0.6% by weight. The residual butanol content lies suitably in a range of from about 0.0001% by weight to about 0.5% by weight, and it is especially preferred that the residual butanol content lies in a range of from about 0.0002% by weight to about 0.3% by weight.

Zeolites having a high degree of hydrophobicity, optionally after certain modifications, are zeolites of pentasil type, faujasite type, mordenite, erionite and zeolite L. U.S. Pat. No. 3,702,886 and U.S. Pat. No. 4,061,724, hereby incorporated by reference, describe how to produce zeolites of pentasil type. Specific examples of zeolites of the pentasil type are ZSM-5, ZSM-11, ZSM-8, ZETA-1, ZETA-3, NU-4, NU-5, ZBM-10, TRS, MB-28, Ultrazet, TsVKs, TZ-01, TZ-02 and AZ-1. In the present context the zeolite of pentasil type is conveniently ZSM-5 or ZSM-11, preferably ZSM-5, both defined by P. A. Jacobs et al in "Synthesis of high-silica aluminosilicate zeolites, Studies in surface science and catalysis", Vol. 33, Elsevier, 1987, pp 167–176, hereby incorporated by reference. Specific examples of faujasite type zeolites are Linde X, Linde Y, SAPO-37, CSZ-37, and LZ-210, all disclosed in "Atlas of zeolite structure types" referred to above.

Many conventional dispersion/stabilising agents, especially such ones of rather low molecular weights, block the sorption capacity of zeolites by being adsorbed to the inner surfaces of the zeolites; the same problem applies to surfactants in general. Biogums, however, are heteropolysaccharides of high molecular weights, generally greater then one million, these being prepared by fermentation of a carbohydrate under the action of micro-organisms. Exemplary of biogums that can be used in the present dispersion are such biogums mentioned in U.S. Pat. No. 5,234,493, which document relates to suspensions of silica particles, not zeolite particles, and which suspensions require, in contrast to the present dispersions, surfactants to be stable. The indicated biogums are obtainable by fermentation of a carbohydrate by bacteria or fungi of the genus Xanthomonas, Arthrobachter, Azotobacter, Agrobacter, Alcaligenes, Erwinia, Rhizobium, Corticum, Scherotinia, Stromatinia or Sclerotiom; mixtures of such biogums are also usable in the dispersions of the present invention. The term "obtainable" is used to indicate that said fermentation may not be the only way to obtain said biogums, but that they may optionally also be obtained through for instance purely synthetical processes. A preferred biogum is a gum obtainable by fermentation of the bacteria of the genus Xanthomonas, i.e. xanthan gum.

Preferably, the electric conductivity of the present dispersion is at least about 3 mS/cm. Below this conductivity value the stability of the dispersions decreases rapidly, eventually resulting in hard sediments. The conductivity is preferably below about 20 mS/cm in order to keep the salt content in the fibrous products low. A preferred conductivity range for the present dispersion is from about 4 to about 15 mS/cm, preferably from about 4 to about 8 mS/cm. The conductivity of the dispersion may be controlled by any suitable means, for instance by addition of a suitable amount of an electrolytically active substance such as an alkali metal salt, e.g. sodium sulphate, aluminium sulphate, or sodium chloride, or an acid, preferably an inorganic acid such as sulphuric acid, hydrochloric acid, or nitric acid.

The pH of the aqueous dispersion of the present invention is preferably about 2–7, particularly about 3–5, in order to optimise the stability of the dispersion.

The size of the hydrophobic zeolite particles may have some impact on the stability of the present dispersion. Thus the particle size is preferably smaller than about 15 μm, i.e. about 50 percent by volume of the hydrophobic zeolite should preferably have a particle size of less than about 15 μm.

It is often desirable to have the dry solids content of the hydrophobic zeolite dispersion as high as possible. The present invention makes it possible to obtain hydro- phobic zeolite dispersions having dry solids contents of about 30–50% by weight using as little as about 0.1–0.8% by weight of biogum, based on the weight of the hydrophobic zeolite particles; these dispersions have shown to have quite manageable viscosities, which is often conditional for their use.

The present dispersion may advantageously be used in the production of packaging material such as described in EP-B-0 540 075 or for sizing of paper as disclosed in U.S. Pat. No. 5,374,335, especially for reduction of dust problems and for lowering the costs of energy and labour. The activity of a pulverulent hydrophobic zeolite is usually blocked by sorption of substances from the air prior to suspension in water, but once the hydrophobic zeolite is suspended in water, such activity reducing sorption is largely avoided; thus, the present dispersion secures the activity of the hydrophobic zeolite. Prior art suspensions are unstable and produce sediments unless constantly agitated, leading to dosage, measuring, and transport problems. All of these problems are removed by the present invention, which opens a feasible way to prepare transportable hydrophobic zeolite dispersions.

Another advantage of the present dispersion is that it simplifies surface application to paper and paperboard when compared with the more unstable prior art dispersions.

The present dispersion provides for good dewatering and retention effects when added to fibre stocks in wet production processes for pulp or paper. The effects are at least as good as the best ones obtained when using prior art stabilising agents. Thus the present invention also relates to a method for production of paper or paperboard by forming and dewatering a suspension of cellulosic fibres, and optional fillers, in which the dewatering is carried out in the presence of particles of a hydrophobic zeolite and the present dispersion is added to the suspension prior to dewatering. Furthermore, the present dispersion has shown to give very good retention results regarding fluff and fluff pulp, in that the overall retention, i.e. the retained amount of hydrophobic zeolite in the fluff after dry-shredding of the fluff pulp, is increased by the present dispersion. Tests have shown that the hydrophobic zeolite retention in fluff obtained from dry-shredding of fluff pulp, to which the hydrophobic zeolite has been added while the pulp was in an aqueous suspension, may be increased by 20–30% if the present dispersion is used instead of a conventional hydrophobic zeolite/water slurry.

The present hydrophobic zeolite dispersion may also be used for application of hydrophobic zeolite on the surfaces of fibres, natural as well as synthetic, when added to the fibres while they are in a dry state. Thus, the present invention particularly relates to a method for production of dry-laid paper, nonwoven or fluff pulp, in which the present dispersion is sprayed onto the fibres while the latter are in an essentially dry state, and particularly when they are carried by a flow of gas such as for instance air, nitrogen, or carbon dioxide.

Retention is a parameter of great significance with regard to the outcome of the methods described in EP-B-0 540 075 and U.S. Pat. No. 5,374,335. The present invention provides for high primary retention in wet as well as dry systems, no matter what type of fibres is used or whether any other retention agent is present in the system or not.

Apart from cellulosic fibres, which may be obtained from e.g. the CTMP or the Kraft processes, the present dispersion may be applied on various synthetic fibres made of e.g. nylon, polyacetates, viscose, polyaramide etc.

The present hydrophobic zeolite dispersion may be prepared by the following method:

I) Pulverulent hydrophobic zeolite is mixed with a biogum into a dry mixture;

II) the dry mixture is mixed with water, while being agitated, into a homogeneous mixture; and III) optionally, the conductivity and/or the pH of the homogeneous mixture is adjusted.

Adjuvants such as for instance bactericides may also be added to the dispersion.

Mixing the hydrophobic zeolite particles with the biogum while dry has shown to provide for the best stability of the resulting dispersion.

Another method for preparation of the present dispersion comprises the steps of

I) preparing an aqueous solution comprising hydrophobic zeolite particles dispersed in water;

II) optionally adjusting the conductivity and/or the pH of the aqueous solution; and II) dispersing biogum in the aqueous solution.

The following specific examples are given in order to further illustrate the present invention, it being understood that the same are intended only to be illustrative and are in no way intended to limit the scope of the present invention.

EXAMPLE 1

The hydrophobic zeolite used was of the ZSM-5 type, having a molar ratio of $SiO_2$ to $Al_2O_3$ in tetrahedral coordination of 32, and a hydrophobicity of below about 0.9 percent by weight residual butanol as determined by the Residual Butanol Test. The pulverulent hydrophobic zeolite showed a pH of 3.7 when in an aqueous slurry. The dry solids content of the hydrophobic zeolite was about 96% by weight and the average size of the hydrophobic zeolite particles was about 10 μm. 208 g pulverulent hydrophobic zeolite was mixed with 0.8 g dry xanthan gum. The dry mixture was carefully poured into about 290 g water and was subjected to forceful stirring. After stirring for 10 minutes pH was measured to be 3.6 and the conductivity, which was measured according to standard method SIS 028123, was 0.33 mS/cm. 2.5 g water-free $Na_2SO_4$ was added under stirring, upon which the mixture was stirred for 5 additional minutes. The conductivity then showed to be 5.5 mS/cm. After filtration the dispersion was poured onto a plastic bottle, which was agitated by a shaking apparatus for 3 days. The resulting dispersion, which was easy to stir, did not show any transparent phase and there was no sediment found in the plastic bottle. The conductivity was measured to 4.36 mS/cm and the pH to 3.6. Two weeks later the dispersion, which was according to the present invention, was still easy to stir and no sediment was present.

EXAMPLE 2

Example 1 was repeated, except that no $Na_2SO_4$ was added. After 3 days a transparent liquid phase of 12 mm appeared, and the rest of the sample was hard as stone. The conductivity was measured to 0.23 mS/cm and the pH to 4.0. This Example indicates that the electric conductivity of the dispersion may be an important feature in some embodiments of the present invention.

EXAMPLE 3

Example 1 was repeated, except that pH was adjusted with sulphuric acid to 2.5 and that no $Na_2SO_4$ was added. After 3 days the entire dispersion sample was hard as stone. The conductivity was measured to 1.378 mS/cm and the pH to 2.7. This Example too indicates that the electric conductivity of the dispersion may be an important feature in some embodiments of the present invention.

EXAMPLE 4

A pulverulent hydrophobic zeolite of the same kind as used in Example 1 and showing a pH of 10.0, when in an aqueous slurry, was used. The dry solids content of the hydrophobic zeolite was about 96% by weight and the average size of the hydrophobic zeolite particles was about 8 μm. 208 g pulverulent hydrophobic zeolite was mixed with 0.8 g dry xanthan gum. The dry mixture was carefully poured into about 290 g water and was subjected to forceful stirring. After stirring for 10 minutes the conductivity was 0.33 mS/cm. Sulphuric acid was added to adjust pH to 3.0, upon which the mixture was stirred for 5 additional minutes. The conductivity then showed to be 5.5 mS/cm. After filtration the dispersion was agitated as in Example 1 for 3 days. The resulting dispersion did not show any phase separation and the dispersion was easy to stir. The conductivity was measured to 5.02 mS/cm and the pH to 3.0. Two weeks later the dispersion, which was according to the present invention, was still easy to stir and no phase separation appeared.

EXAMPLE 5

Example 4 was repeated, except that only half the portion of sulphuric acid was added and that $Na_2SO_4$ was added until about the same conductivity as in Example 4 was reached. After 3 days no phase separation could be detected and the dispersion was easy to stir. The conductivity was measured to 5.48 mS/cm and the pH to 7.4. Two weeks later the dispersion, also according to the present invention, was still easy to stir and no phase separation could be detected.

EXAMPLE 6

Example 1 was repeated, except that ethylhydroxyethyl cellulose was used instead of xanthan gum. A portion of the sample was not agitated; this portion showed a transparent phase and a small amount of sediment, which was easy to slurry by stirring. Agitation, however, made the sample very hard. The conductivity was measured to 6.85 mS/cm and pH to 3.7. This Example shows that prior art technology does not provide stable dispersions of hydrophobic zeolites.

EXAMPLE 7

Example 1 was repeated, except that ethylhydroxyethyl cellulose was substituted for half the used amount of xanthan gum. A portion of the sample was not agitated; this portion showed good stability. Agitation, however, produced a sediment that was difficult to slurry by stirring. The conductivity was measured to 6.85 mS/cm and pH to 3.7. This Example indicates that the present invention may be used to improve prior art dispersions.

EXAMPLES 8

Aqueous dispersions of hydrophobic zeolite of the same kind as in Example 1 were prepared using Dispex N-40, which is an anionic polyacrylate dispersing agent, in concentrations of 0.2, 0.5 and 1 wt-%, based on dry hydrophobic zeolite. The dry contents of the dispersions varied from 20% to 40% and the pH of the dispersions were 4.5, 7 and 9, respectively. Irrespective of mixing conditions sedimentation appeared very quickly in the dispersions. After one day the hydrophobic zeolite material had settled at the bottom as a very hard cake. This Example shows that prior art technology does not provide stable dispersions of hydrophobic zeolites.

EXAMPLE 9

Example 1 was repeated, except that 21 g $Na_2SO_4$ was added (instead of 2.5 g as in Example 1). After 3 days of agitation a 3 mm thick sediment had gathered at the bottom. The conductivity was measured to 25 mS/cm and the pH to 3.0. This Example indicates that the electric conductivity of the dispersion may be an important feature in some embodiments of the present invention.

EXAMPLE 10

Table I below shows the results of retention tests in which a hydrophobic zeolite as used in Example 1 and xanthan gum were added to fibrous suspensions containing fibres from a Kraft pulp of 60% hardwood and 40% softwood. The pulp concentration was 1% by weight. The hydrophobic zeolite was added in an amount of 10 kg/ton of dry pulp. The suspension was dewatered and the fibres were formed into a sheet, which was dried at 105° C. The degree of retention of the hydrophobic zeolite was measured by means of the ash content, which was determined by combustion at 925° C. for 120 min, upon which the remainder was weighed. In test Nos. 1 and 3 the hydrophobic zeolite was added to the fibrous suspension separate from the xanthan gum, whereas in test Nos. 2 and 4 the hydrophobic zeolite was mixed with the xanthan gum prior to being added to the fibrous suspension. In Table I the additions of hydrophobic zeolite and xanthan gum are calculated per ton of dry pulp.

TABLE I

| Test No. | Addition of xanthan gum, g/ton | Separate additions or premixed | Ash content, % |
|---|---|---|---|
| 1 | 40 | separate | 0.45 |
| 2 | 40 | premixed | 0.64 |
| 3 | 200 | separate | 0.48 |
| 4 | 200 | premixed | 0.86 |

Evidently, a premix of xanthan gum and hydrophobic zeolite gives better retention separate addition.

EXAMPLE 11

In test A, an aqueous dispersion of a hydrophobic zeolite was red and added, while stirring at 1000 rpm, to a fibrous suspension as described in Example 10. The added amount of hydrophobic zeolite was 10 kg/ton of dry pulp. The suspension was dewatered and the fibres were formed into a sheet, which was dried at 105° C. The ash content of the sheet after forming was determined as in Example 10. Thereafter the sheet was dry-shredded into fluff, upon which the ash content of the obtained fluff was determined. In test B the aqueous hydrophobic zeolite dispersion additionally contained xanthan gum in an amount of 40 g/ton of dry pulp, i.e. the dispersion was according to the present invention. The results of the tests are set forth in Table II below. The ash contents have been converted into the amount of hydrophobic zeolite present in the pulp sheet and in the fluff, respectively.

TABLE II

| Test | Xanthan gum, g/ton of dry pulp | Hydrophobic zeolite content after forming, kg/ton of dry pulp | Hydrophobic zeolite content after dry-shredding, kg/ton of dry pulp |
|---|---|---|---|
| A | 0 | 6.3 | 2.9 |
| B | 40 | 8.6 | 5.1 |

As can be seen in Table II, the retention of hydrophobic zeolite was better after forming as well as after dry-shredding when using a dispersion according to the present invention.

EXAMPLE 12

An aqueous solution containing 2 g/l of a hydrophobic zeolite as used in Example 1 were sprayed onto sheets of pulp, the sheets being prepared as described in Example 10. The added amount of hydrophobic zeolite corresponded to 3 kg hydrophobic: zeolite/ton of dry pulp. In Test C, the solution additionally contained 0.04% of xanthan gum, whereas Test D was a comparison test without any biogum added. After having being sprayed, the pulp sheets were shredded in a hammer mill, and the ash contents were determined as in the previous Examples and converted into the corresponding amount of hydrophobic zeolite present in the shredded pulp. The results of the Tests are set forth in Table III below.

TABLE III

| Test | Xanthan gum, g/ton of dry pulp | Hydrophobic zeolite added to pulp sheet, kg/ton of dry pulp | Hydrophobic zeolite content after dry-shredding, kg/ton of dry pulp |
|---|---|---|---|
| C | 0 | 3.0 | 2.0 |
| D | 12 | 3.0 | 2.4 |

Evidently the retention of hydrophobic zeolite was better when using a dispersion according to the present invention.

EXAMPLE 13

The hydrophobic zeolite used in this Example was of the Y type, having a $SiO_2$:$Al_2O_3$ ratio of 29, and a hydrophobicity of 0.28 percent by weight residual butanol as determined by the Residual Butanol Test. The pulverulent hydrophobic zeolite showed a pH of 3.7 when in an aqueous slurry. The dry solids content of the hydrophobic zeolite was about 96% by weight. 208 g pulverulent hydrophobic zeolite was mixed with 0.8 g dry xanthan gum. The dry mixture was poured into about 290 g water and was stirred as in Example 1 for 10 minutes, after which the pH was measured to be 3.6 and the conductivity was 0.33 mS/cm. 2.5 g $Na_2SO_4$ was added as in Example 1, and then the conductivity showed to be 5.6 mS/cm. After filtration the dispersion was poured onto a plastic bottle, which was agitated for 3 days. The resulting dispersion was easy to stir, did not show any transparent phase and there was no sediment found in the plastic bottle. One and a half weeks later the dispersion was still easy to stir and no sediment was present.

We claim:

1. An aqueous dispersion comprising particles of a zeolite having a hydrophobicity of below about 0.9 percent by weight residual butanol as determined by the Residual Butanol Test, wherein said dispersion comprises a stabilising amount of a biogum.

2. The dispersion of claim 1 wherein the electrical conductivity of the dispersion is from about 3 mS/cm to about 20 mS/cm.

3. The dispersion of claim 1 wherein the biogum is obtained via fermentation of a carbohydrate by bacteria or fungi of the genus Xanthomonas, Arthrobachter, Azotobacter, Agrobacter, Alcaligenes, Erwinia, Rhizobium, Corticum, Scherotinia, Stromatinia or Sclerotiom.

4. The dispersion according to claim 1 wherein the biogum is xanthan gum.

5. The dispersion according to claim 1 wherein the zeolite has a hydrophobicity of below about 0.6 percent by weight residual butanol as determined by the Residual Butanol Test.

6. The dispersion of claim 1 having a pH of from about 2–7.

7. The dispersion of claim 1 wherein the conductivity of the dispersion is from about 4 mS/cm to about 15 mS/cm.

8. The dispersion of claim I which comprises about 0.1–0.8% by weight of the biogum, relative to the weight of said zeolite particles, and has a dry solids content of about 30–50% by weight.

* * * * *